US005703429A

United States Patent [19]

Kim et al.

[11] Patent Number: 5,703,429

[45] Date of Patent: *Dec. 30, 1997

[54] DIRECTLY HEATED CATHODE STRUCTURE

[75] Inventors: Chang-seob Kim; Seok-bong Son, both of Suwon; Sang-kyun Kim; Bong-uk Jeong, both of Seoul, all of Rep. of Korea

[73] Assignee: Samsung Display Devices Co., Ltd., Kyungki-do, Rep. of Korea

[ * ] Notice: The term of this patent shall not extend beyond the expiration date of Pat. No. 5,668,434.

[21] Appl. No.: 571,479

[22] Filed: Dec. 13, 1995

[30] Foreign Application Priority Data

Dec. 28, 1994 [KR] Rep. of Korea ..... 94-38313

[51] Int. Cl.[6] ..... H01J 19/06

[52] U.S. Cl. ..... 313/346 R; 313/346 DC

[58] Field of Search ..... 313/346 DC, 346 R, 313/355, 411, 451, 345

[56] References Cited

U.S. PATENT DOCUMENTS

| | | | |
|---|---|---|---|
| 3,495,122 | 2/1970 | Hubner et al. | 313/346 |
| 3,671,792 | 6/1972 | Waltermire | 313/337 |
| 4,350,920 | 9/1982 | Bertens | 313/346 R |
| 4,823,044 | 4/1989 | Falce | 313/346 |
| 5,171,180 | 12/1992 | Lee | 313/346 DC |

FOREIGN PATENT DOCUMENTS

| | | |
|---|---|---|
| 0157634 | 10/1985 | European Pat. Off. . |
| 8705725 | 11/1987 | Germany . |
| 60-59641 | 4/1985 | Japan . |
| 61-51723 | 3/1986 | Japan . |
| 61-163432 | 7/1986 | Japan . |
| 61-216222 | 9/1986 | Japan . |
| 2060246 | 4/1981 | United Kingdom . |

*Primary Examiner*—Sandra L. O'Shea
*Assistant Examiner*—Joseph Williams
*Attorney, Agent, or Firm*—Leydig, Voit & Mayer, Ltd.

[57] ABSTRACT

A directly heated cathode structure includes a porous pellet impregnated with an electron radiating material, a cup-shaped container holding the porous pellet, a metal member welded to the container, and a filament between the container and the metal member, restricting thermionic emission through the base and sides of the pellet and extending the life of the cathode structure.

16 Claims, 2 Drawing Sheets

DIRECTLY HEATED CATHODE STRUCTURE

BACKGROUND OF THE INVENTION

The present invention relates to a directly heated cathode structure for a cathode-ray tube (CRT), and more particularly, to a directly heated dispenser cathode structure for use in a color CRT electron gun.

A cathode absorbs heat energy and emits thermions and may generally be divided into directly heated and indirectly heated types, according to the manner of heating the emitting source material. In a directly heated cathode, the filament and emitting source are in direct contact with each other, while being separated in an indirectly heated cathode.

The directly heated cathode is most often applied to an electron gun of such a small CRT as is used in a viewfinder of a video camera, directly fixed to a filament and provided with a base metal coated with an electron-radiating material or a pellet impregnated with a cathode material for a large CRT for a TV or a computer monitor. A porous pellet structure directly fixed to a filament has been developed by the present applicant (refer to U.S. patent application Ser. No. 08/120,502), as shown in FIG. 1. Here, a single filament 102 penetrates a porous pellet 101 impregnated with electron-radiating material. Alternatively, a pair of such filaments are directly welded to the sides of the porous pellet.

The present applicant has also filed a patent application (U.S. patent application Ser. No. 08/429,529) describing a cathode structure in which the supporting structure of a pellet is reinforced by the filaments themselves. That is, the filaments are directly welded to (or penetrate) at least three points on the sides of a porous pellet impregnated with an electron-radiating material.

The above-mentioned directly heated cathode structures need only a very short interval for starting thermionic emission after current is applied and exhibit high-density thermionic emission, since the porous pellet is directly heated by the filament current with the filament in contact with the pellet body. However, there is a loss in the thermionic emitting material since thermionic emission passes through the entire surface of the pellet (i.e., including the sides thereof). The thermionic radiating material evaporated from the pellet to the filament can embrittle the filament. Also, the process of attaching the filament to the pellet (either by welding or by passing through the pellet) is difficult to achieve in practice, resulting in lower productivity.

Further, the present applicant has also developed a directly heated cathode having an improved structure, as shown in FIG. 2. Described in U.S. patent application Ser. No. 08/579,519, filed Dec. 27, 1995; Here, a filament 210 is fixed to a metal member 220 which is arranged under a pellet 200 where electron radiating material is impregnated. Thus, since metal member 220 covers the base of pellet 200, thermionic emission through the base of pellet 200 is effectively blocked.

However, a small portion of the thermions escape through minute gaps which exist between pellet 200 and metal member 220. Moreover, since the pellet sides also constitute thermionic emission surface areas, continuous and uniform thermion emission cannot be achieved. Further, the life of pellet 200 is shortened due to the rapid consumption of the electron radiating material, and, as in the case of the aforementioned structure, the electron radiating material evaporated from the sides of pellet 200 can embrittle the filament.

SUMMARY OF THE INVENTION

To solve the above problems, it is an object of the present invention to provide a directly heated cathode structure by which emission through the base and sides of a pellet is restricted.

It is another object of the present invention to provide a high quality directly heated cathode structure having improved stability and greater productivity.

Accordingly, to achieve the above objects, there is provided a directly heated cathode structure comprising a porous pellet where electron radiating material is impregnated, a cup-shaped container for holding the porous pellet, a metal member being welded at the base of the container, and a filament arranged between the container and the metal member.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF THE INVENTION

Figure 1:
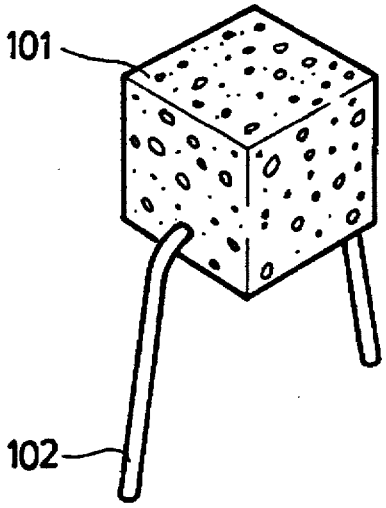
FIG. 1 (PRIOR ART)
FIG. 1 is a perspective view illustrating a conventional directly heated cathode structure.
Figure 2:
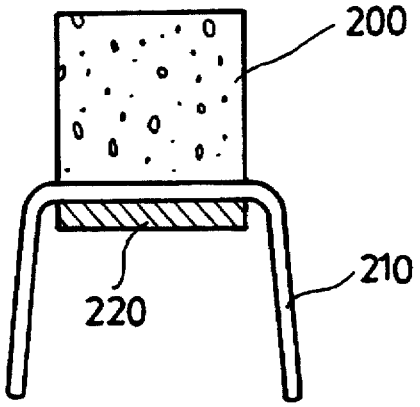
FIG. 2 is a section illustrating another conventional directly heated cathode structure.
Figure 3:
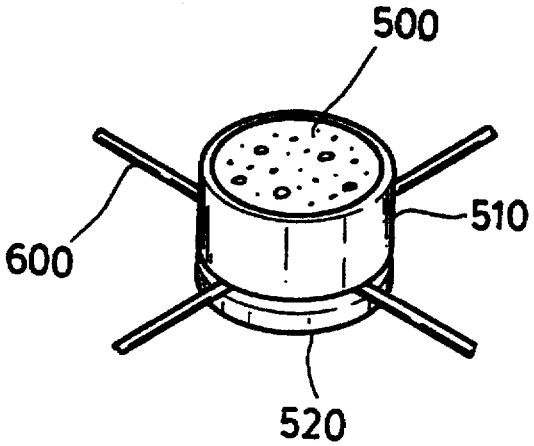
FIG. 3 is a schematic perspective view illustrating a directly heated cathode structure according to the present invention.
Figure 4:
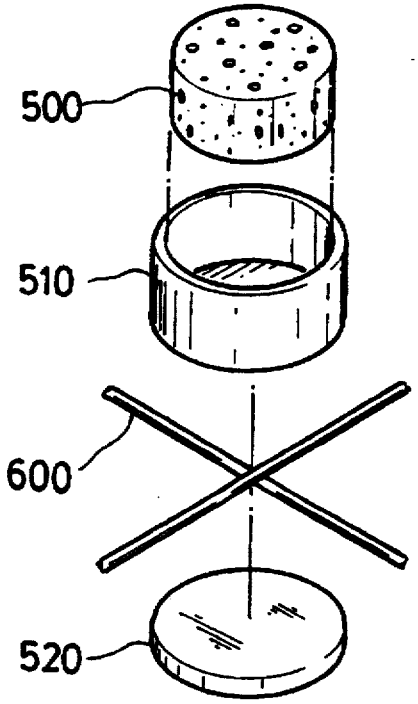
FIG. 4 is an exploded perspective view illustrating the directly heated cathode structure of FIG. 3.
Figure 5:
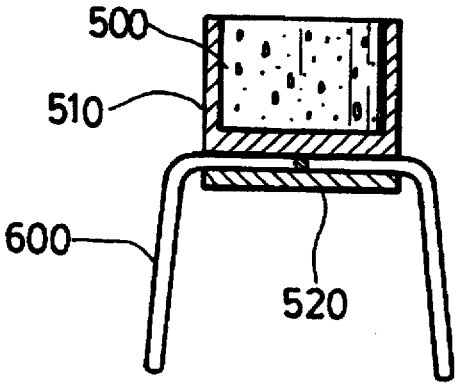
FIG. 5 is a sectional view illustrating the directly heated cathode structure of FIG. 3.

Referring to FIGS. 3–5, electron radiating material is impregnated in a porous pellet 500 of metal having a high melting point. Porous pellet 500 is inserted into a cup-shaped container 510 for protecting the pellet 500 by enclosing the sides and base thereof. A filament 600 is provided under container 510. Under the filament 600, a metal member 520 is provided for fixing the filament to the base of container 510. Both the filament 600 and the metal member 520 are fixed to the base of container 510 by welding.

In an exemplary embodiment, the porous pellet 500 is made of tungsten (W), ruthenium (Ru), molybdenum (Mo), nickel (Ni) and/or tantalum (Ta), and the material used for container 510 and metal member 520 includes molybdenum (Mo), tungsten (W) and/or tantalum (Ta).

In the present invention, the container 510 containing the pellet 500 has an inner diameter of 0.50–2.00 mm, and the thickness of the container 510 is 0.02–0.50 mm. Container 510 can be a circular, rectangular or a polygonal cylinder. The filament 600, preferably comprises a Re-alloy, of which the main constituent is tungsten or molybdenum. It is also preferred that the diameter of the filament is 0.020–50 mm. Metal member 520 has a shape corresponding to that of the base of container 510, with a preferred diameter and a thickness matching those of the container 510.

For the welding of container 510 and metal member 520, resistance welding, laser welding, arc welding or plasma welding can be used. It is preferred that two or more filaments are arranged cross-wise or radially, for more efficient pellet heating.

The directly heated cathode structure according to the present invention has the following merits.

First, since the pellet in which electron radiating material is impregnated is held and protected in the container, oxidation of the electron radiating material due to the welding heat generated during the welding of the container and metal member, can be prevented.

Second, since the filament is welded to the container containing the pellet, the binding strength between the pellet and the filament can be improved.

Third, since the pellet is held in the container, only the top side of which being exposed, the vaporization of the thermion emission material is minimized, so that a lengthening; of the cathode's life can be achieved.

Fourth, since the electron radiating material is partially evaporated through the top side of the pellet, the filament embrittlement phenomenon due to the attaching of the electron radiating material to the filament can be avoided.

The cathode structure according to the present invention can be used in color CRTs for large-screen televisions and computer monitors, as well as in small black-and-white CRTs.

What is claimed is:

1. A directly heated cathode structure comprising:

a porous pellet impregnated with an electron radiating material;

a cup-shaped container holding said porous pellet;

a metal member welded to said container; and a filament disposed between said container and said metal member.

2. The directly heated cathode structure as claimed in claim 1, wherein said filament comprises a plurality of filament members arranged radially.

3. The directly heated cathode structure as claimed in claim 1, wherein said pellet comprises at least one metal selected from the group consisting of tungsten, ruthenium, molybdenum, nickel, and tantalum.

4. The directly heated cathode structure as claimed in claim 1, wherein said filament includes tungsten and ruthenium.

5. The directly heated cathode structure as claimed in claim 1, wherein said filament has a diameter in the range of 0.02–0.50 mm.

6. The directly heated cathode structure as claimed in claim 2, wherein said filament has a diameter in the range of 0.02–0.50 mm.

7. The directly heated cathode structure as claimed in claim 1, wherein said container comprises at least one metal selected from the group consisting of molybdenum, tungsten, and tantalum.

8. The directly heated cathode structure as claimed in claim 2, wherein said container comprises at least one metal selected from the group consisting of molybdenum, tungsten, and tantalum.

9. The directly heated cathode structure as claimed in claim 7, wherein said container has a thickness in the range of 0.02–0.50 mm.

10. The directly heated cathode structure as claimed in claim 8, wherein said container has a thickness in the range of 0.02–0.50 mm.

11. The directly heated cathode structure as claimed in claim 1, wherein said metal member comprises at least one metal selected from the group consisting of molybdenum, tungsten, and tantalum.

12. The directly heated cathode structure as claimed in claim 2, wherein said metal member comprises at least one metal selected from the group consisting of molybdenum, tungsten, and tantalum.

13. The directly heated cathode structure as claimed in claim 11, wherein the diameter of said metal member is in the range of 0.50–2.00 mm and its thickness is in the range of 0.02–5.00 mm.

14. The directly heated cathode structure as claimed in claim 12, wherein the diameter of said metal member is a cylinder having a diameter in a range of 0.50–2.00 mm and a thickness in the range of 0.02–5.00 mm.

15. The directly heated cathode structure as claimed in claim 1, wherein said pellet is cylindrical.

16. The directly heated cathode structure as claimed in claim 1, wherein said pellet has a polygonal column shape.

* * * * *